US010175024B2

(12) United States Patent
Walthert

(10) Patent No.: US 10,175,024 B2
(45) Date of Patent: Jan. 8, 2019

(54) ARCHERY CABLE DIRECTOR FOR ARCHERY BOWS

(71) Applicant: Perfect Form Manufacturing LLC, West Henrietta, NY (US)

(72) Inventor: Hans Walthert, Rush, NY (US)

(73) Assignee: Perfect Form Manufacturing LLC, West Henrietta, NY (US)

( * ) Notice: Subject to any disclaimer, the term of this patent is extended or adjusted under 35 U.S.C. 154(b) by 0 days.

(21) Appl. No.: 15/782,385

(22) Filed: Oct. 12, 2017

(65) Prior Publication Data

US 2018/0106573 A1 Apr. 19, 2018

Related U.S. Application Data

(60) Provisional application No. 62/407,697, filed on Oct. 13, 2016.

(51) Int. Cl.
*F41B 5/10* (2006.01)
*F41B 5/14* (2006.01)

(52) U.S. Cl.
CPC ..... *F41B 5/1403* (2013.01); *F41B 5/10* (2013.01)

(58) Field of Classification Search
CPC ..... F41B 5/10
See application file for complete search history.

(56) References Cited

U.S. PATENT DOCUMENTS 3,574,944 A 4/1971 Reynolds
4,156,496 A 5/1979 Stinson
4,207,858 A 6/1980 Blackstone
4,377,152 A 3/1983 Saunders
4,452,222 A 6/1984 Quartino et al.
4,542,732 A 9/1985 Troncoso
4,596,228 A 6/1986 Smith
4,886,038 A 12/1989 Betters
4,903,678 A 2/1990 Walker
4,919,108 A 4/1990 Larson
5,178,122 A 1/1993 Simonds
5,392,757 A 2/1995 Head et al.
5,415,149 A 5/1995 Derus et al.
5,651,355 A 7/1997 Gallops, Jr.
5,697,355 A 12/1997 Schaffer
5,718,213 A 2/1998 Gallops, Jr. et al.
5,791,324 A 8/1998 Johnson
5,983,880 A 11/1999 Saunders
6,152,124 A 11/2000 Gallops, Jr.
6,176,231 B1 1/2001 Smith
6,425,385 B1 7/2002 Gallops, Jr.
6,532,945 B1 3/2003 Chattin
6,550,467 B2 4/2003 Gallops, Jr.
(Continued)

OTHER PUBLICATIONS

Walthert; U.S. Appl. No. 62/407,697, filed Oct. 13, 2016.
Batdorf; U.S. Appl. No. 13/226,827, filed Sep. 7, 2011.
Batdorf, U.S. Appl. No. 15/254,706, filed Sep. 1, 2016.

*Primary Examiner* — John Ricci
(74) *Attorney, Agent, or Firm* — Barclay Damon LLP

(57) ABSTRACT

An archery cable director and method are disclosed herein. The archery cable director, in an embodiment, includes an arm, support, cable engager and cable retainer. The arm is configured to be coupled to an archery bow. The support is adjustably coupled to the arm. The cable retainer is configured to manage or regulate access to or the position of a cable of the archery bow.

20 Claims, 11 Drawing Sheets

(56) References Cited

U.S. PATENT DOCUMENTS

| | | | |
|---|---|---|---|
| 6,634,348 | B2 | 10/2003 | Gallops, Jr. |
| 6,708,684 | B2 | 3/2004 | Chattin |
| 6,722,354 | B1 | 4/2004 | Land |
| 6,904,900 | B2 | 6/2005 | Gallops, Jr. |
| 7,793,646 | B2 | 9/2010 | Cooper et al. |
| 8,028,685 | B2 | 10/2011 | Clark |
| 8,371,283 | B2 | 2/2013 | Grace et al. |
| 8,402,960 | B2 | 3/2013 | McPherson |
| 8,424,511 | B2 | 4/2013 | Grace, Jr. et al. |
| 8,485,169 | B2 | 7/2013 | Dahl, II |
| 8,616,189 | B2 | 12/2013 | McPherson et al. |
| 8,651,097 | B2 | 2/2014 | Grace, Jr. et al. |
| 8,671,929 | B2 | 3/2014 | McPherson |
| 8,746,219 | B2 | 6/2014 | Anselmo |
| 8,746,220 | B2 | 6/2014 | McPherson et al. |
| 8,784,628 | B2 | 7/2014 | Grace, Jr. et al. |
| 8,813,737 | B2 | 8/2014 | Langley |
| 8,820,304 | B2 | 9/2014 | Batdorf |
| 8,950,388 | B2 | 2/2015 | McPherson |
| 9,291,422 | B1 | 3/2016 | Gold et al. |
| 2003/0056780 | A1 | 3/2003 | Gallops, Jr. |
| 2009/0165766 | A1 | 7/2009 | Evans |
| 2010/0101549 | A1 | 4/2010 | Grace et al. |
| 2010/0132685 | A1 | 6/2010 | De Sousa |
| 2011/0073090 | A1 | 3/2011 | McPherson |
| 2012/0042861 | A1 | 2/2012 | Anselmo |
| 2013/0055995 | A1 | 3/2013 | Batdorf |
| 2013/0055997 | A1 | 3/2013 | Badgerow |
| 2013/0061838 | A1 | 3/2013 | Gordon et al. |
| 2014/0299116 | A1 | 10/2014 | Yehle |
| 2015/0027425 | A1 | 1/2015 | Yehle |
| 2015/0153133 | A1 | 6/2015 | McPherson' |
| 2017/0184370 | A1* | 6/2017 | McPherson ..... F41B 5/10 |

* cited by examiner

ARCHERY CABLE DIRECTOR FOR ARCHERY BOWS

CROSS-REFERENCE TO RELATED APPLICATION

This application is a continuation of, and claims the benefit and priority of, U.S. Provisional Patent Application No. 62/407,697 filed on Oct. 13, 2016. The entire contents of such application are hereby incorporated by reference.

BACKGROUND

Certain archery bows have a power cable in addition to a bowstring. The power cable and the bowstring are coupled to one or more rotational cams. The power cable can interfere with the passage of the arrow during shooting. For example, during flight, the fletching of the arrow can contact or become entangled with the power cable. A known cable guard is used to provide clearance for the arrow when passing the power cable. This known cable guard has a rod attachable to a bow, a wheel fork (i.e., yoke) connected to the rod, and a wheel connected to the wheel fork. The wheel contacts the power cable. To accommodate differently sized arrows, the position of the wheel fork is laterally adjustable relative to the rod.

This known cable guard has several problems and disadvantages. Based on its design, the wheel fork is subject to become decoupled from the rod during adjustment. For example, during adjustment, the wheel fork can totally slip off of the rod and drop to the ground. This creates challenges and inconveniences for users in their efforts to fine-tune their bows.

Also, this cable guard lacks positioning limits. As a result, users are prone to unintentionally push the wheel fork too far inward resulting or too far outward. An overly-inward position can cause problematic interference with the arrow. An overly-outward position can cause excessive lateral force on the power cable. The excessive lateral force can cause several disadvantages. The excessive lateral force can damage, bind or otherwise increase the wear and tear on the internal bearing components of the bow's cams. The excessive lateral force can also cause the cams to wobble during rotation, causing lateral movement in the bowstring which, in turn, can hinder shooting performance. In addition, the excessive lateral force can cause torque or bending in the riser of the bow which can also hinder shooting performance. Furthermore, these disadvantages can impair the trajectory of the arrow and generally make it more difficult for users to fine-tune their bows in efforts to achieve optimal shooting outcomes.

In addition, the wheel fork of the known cable guard is designed to lock and entrap the power cable. To install the power cable, the user must disassemble the wheel from the wheel fork, insert the power cable within the cavity between the wheel fork and the wheel, and then reattach the wheel to the wheel fork. This can be a time-consuming process which increases the labor and inconvenience of bow setup. This process also increases the inconvenience of changing power cables when they become worn or otherwise need to be replaced.

The foregoing background describes some, but not necessarily all, of the problems, disadvantages and shortcomings related to the known cable guard.

SUMMARY

Features and advantages of the present disclosure are described in, and will be apparent from, the following Brief Description of the Drawings and Detailed Description.

DETAILED DESCRIPTION

Figure 1:
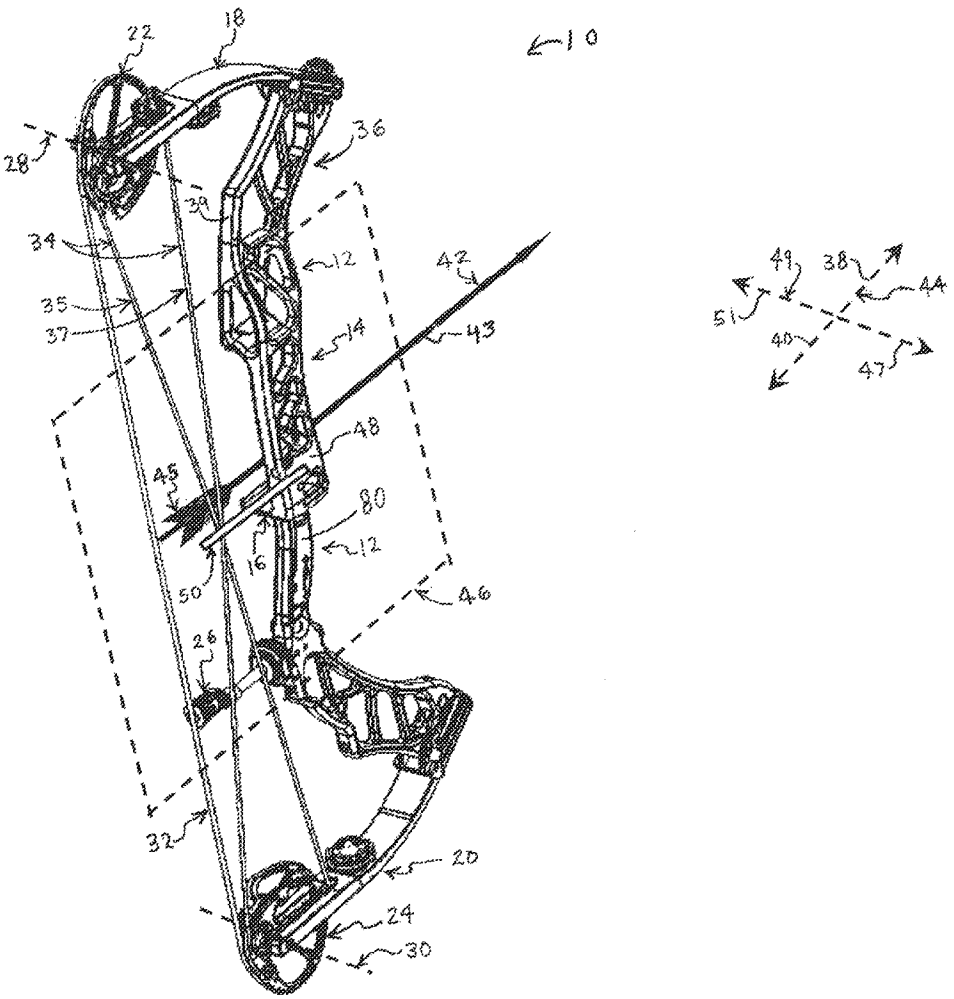
FIG. 1 is a rear, isometric view of an embodiment of an archery bow.

As illustrated in FIG. 1, in an embodiment, the archery bow 10 includes: (a) a main branch or riser 12 having a handle 14 and arrow shelf 16; (b) a plurality of flexible limbs 18, 20 coupled to the riser 12; (c) a plurality of bow rotors 22 and 24 (e.g., wheels, pulleys or cams) that are rotatably coupled to the limbs 18 and 20, respectively; and (d) a vibration dampener 26 connected to the riser 12.

In the embodiment shown, the bow 10 is a compound bow, and both bow rotors 22 and 24 are eccentric cams that rotate about axes 28 and 30, respectively. Each such cam has one or more elliptical, asymmetric or non-circular lever portions configured to: (a) engage the drawstring or bowstring 32; (b) engage the power line, power cord set or power cable set 34; or (c) engage both the bowstring 32 and power cable set 34. The bowstring 32 and power cable set 34 are spooled on the bow rotors 22, 24. As described below, in an embodiment, the power cable set 34 includes power cables 35, 37.

The riser 12 has a front 36 facing in a forward direction 38 toward a shooting target (not shown) and a back 39 facing in a rearward direction 40 opposite the shooting target. The forward direction 38 and rearward direction 40 are directed along a shooting axis 44. The back 39 is positioned closer to the user who readies the archery bow 10 in position to fire a projectile or arrow 42 along or relative to the shooting axis 44. In an embodiment, the arrow 42 includes a shaft 43 and a fletching 45 (e.g., tail, fin, feather or other aerodynamic flight guide) attached to the shaft 43. During shooting, the bowstring 32 moves within a bowstring plane 46 from a retracted or drawn position (not shown) located a distance from the back 39 to a brace or undrawn position (FIG. 1) located closer to the back 39.

Figure 2:
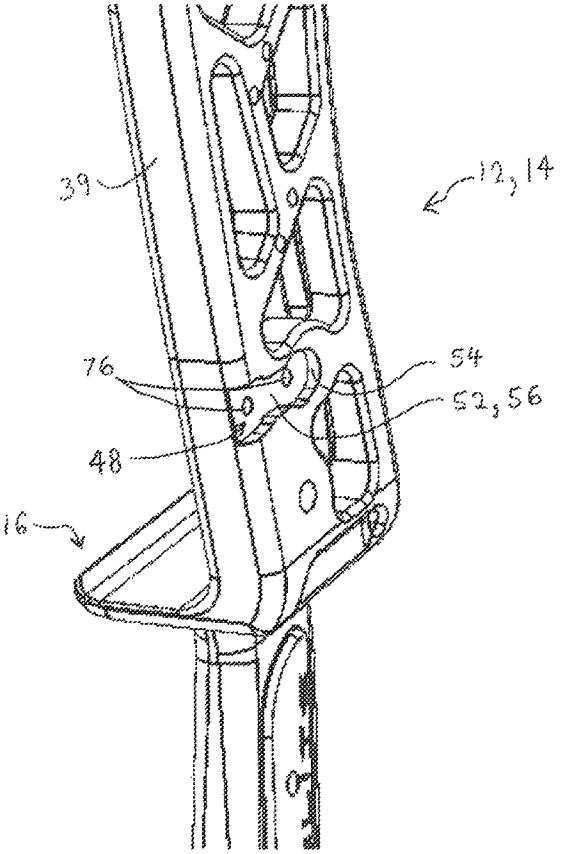
FIG. 2 is a fragmentary, isometric view of the archery bow of FIG. 1, illustrating the mount portion of the riser of the archery bow.
Figure 5:
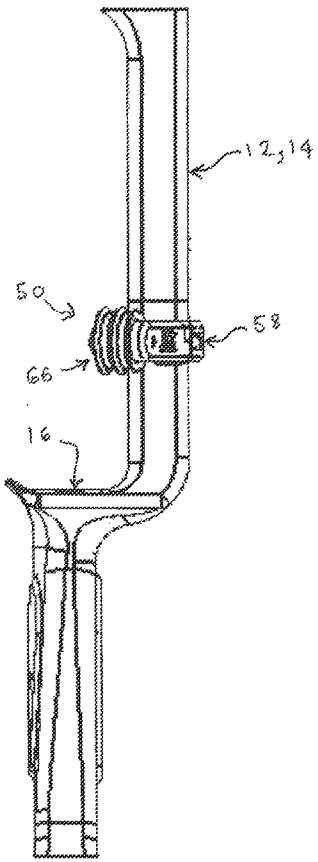
FIG. 5 is a fragmentary, rear view of the archery bow of FIG. 1, illustrating the archery cable director of FIG. 3 attached to the archery bow.
Figure 4:
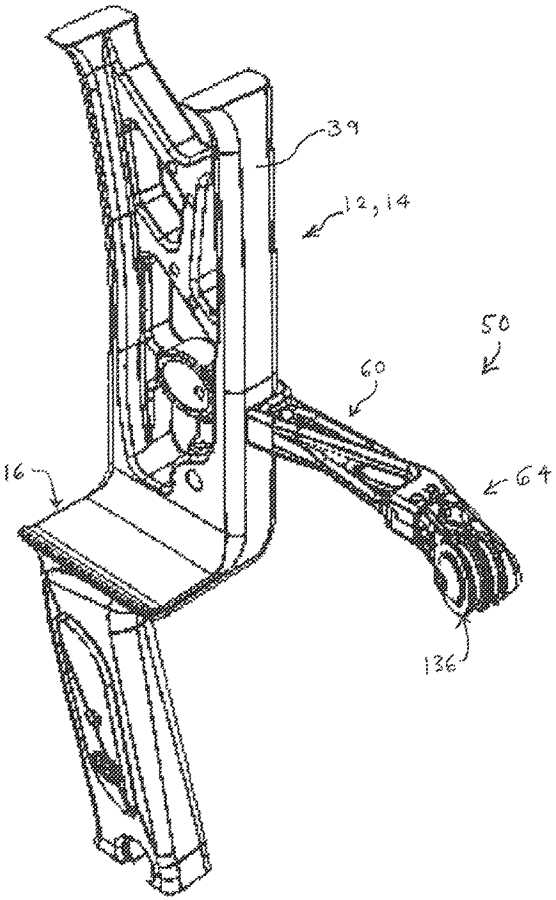
FIG. 4 is another fragmentary, isometric view of the archery bow of FIG. 1, illustrating the archery cable director of FIG. 3 attached to the archery bow.
Figure 6:
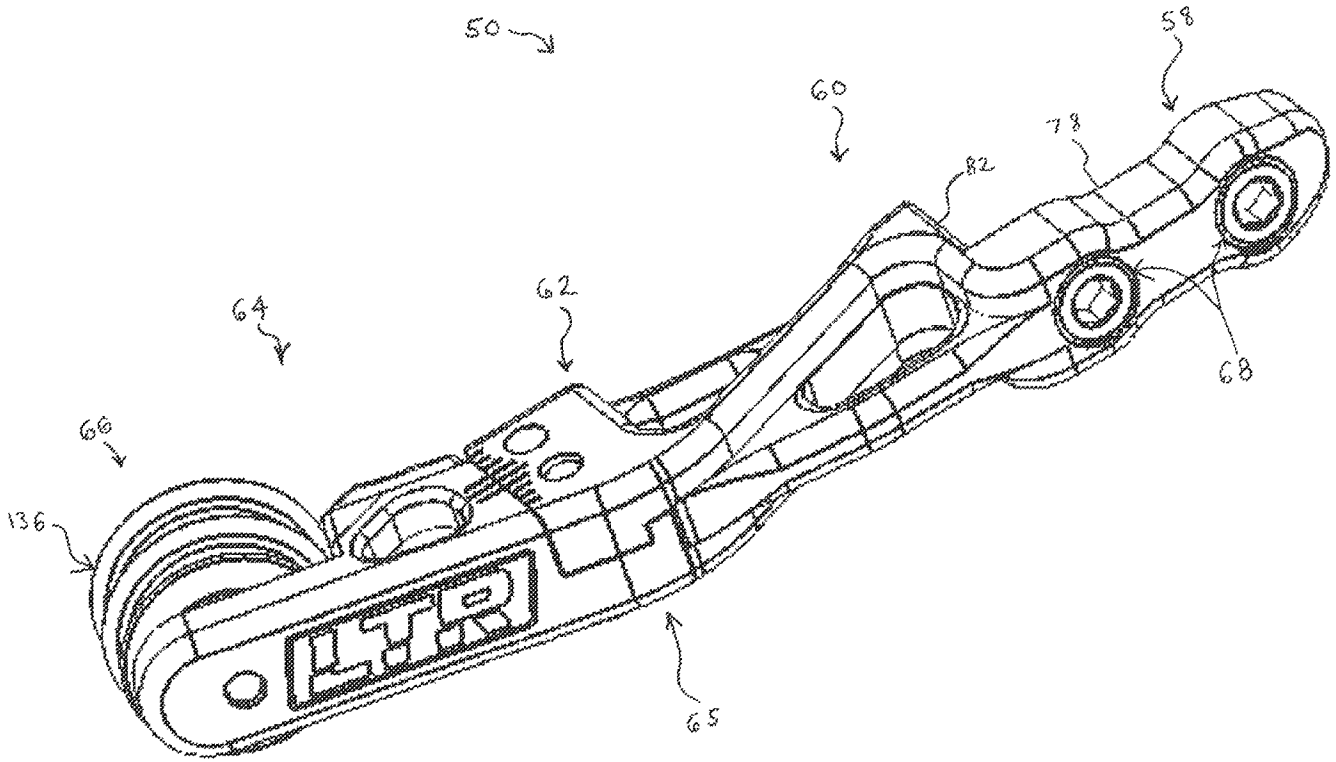
FIG. 6 is a top, isometric view of the archery cable director of FIG. 3.

Referring to FIGS. 1-2, in an embodiment, the riser 12 also defines or includes a mount portion 48 configured to be coupled to the archery cable director 50. As described below, the archery cable director 50 pulls or relocates the power cable set 34 in the outward direction 47 along lateral axis 49. Lateral axis 49 intersects with the bowstring plane 46. In reaction, the power cable set 34 applies a lateral, counter-active force in the inward direction 51, directed along the lateral axis 49. By pulling and positioning the power cable set 34 outward, the archery cable director 50 distances the power cable set 34 apart from the bowstring plane 46 to avoid interference between the power cable set 34 and the fletching 45 of the arrow 42.

Figure 3:
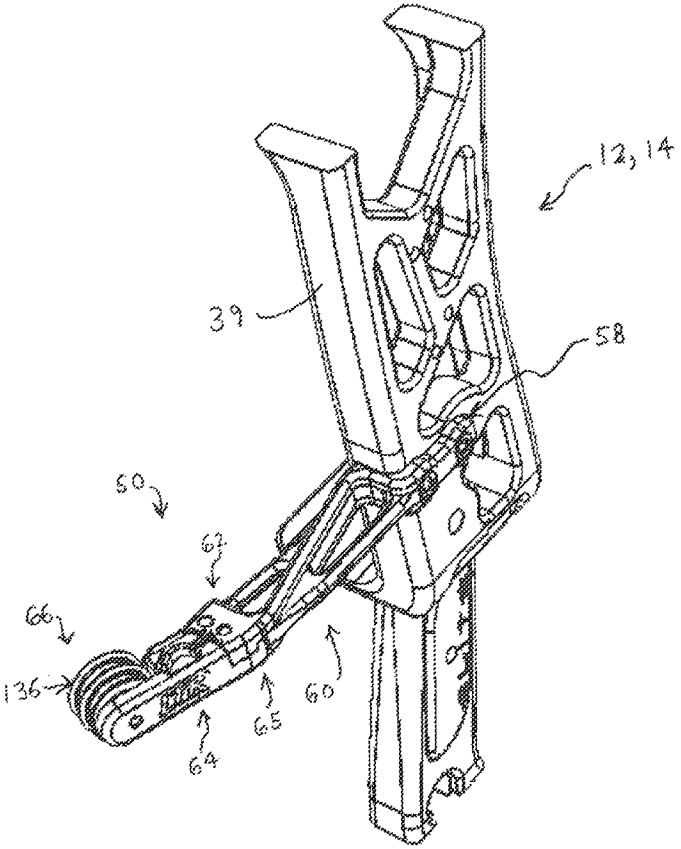
FIG. 3 is a fragmentary, isometric view of the archery bow of FIG. 1, illustrating an embodiment of an archery cable director attached to the archery bow.

As illustrated in FIG. 2, in an embodiment, the mount portion 48 includes a floor 52 extending to a perimeter retaining wall 54. The floor 52 and retaining wall 54 define a cavity 56 configured to receive part or all of the proximal arm end 58 (FIG. 3) of the archery cable director 50, as described below.

As illustrated in FIGS. 3-7, in an embodiment, the archery cable director 50 includes: (a) an arm 60 (e.g., an extension or elongated member) having the proximal arm end 58 and a distal arm end 62; (b) a support 64 having a proximal support end 65 and a distal support end 66; (c) a plurality of mount fasteners 68 (e.g., threaded screws, bolts, pins or other securement devices) configured to mount the proximal arm end 58 to the mount portion 48 of the bow 10; and (d) an adjustment fastener 70 (e.g., a threaded screw, bolt, pin or other securement device) configured to adjustably couple the proximal support end 65 to the distal arm end 62.

Figure 7:
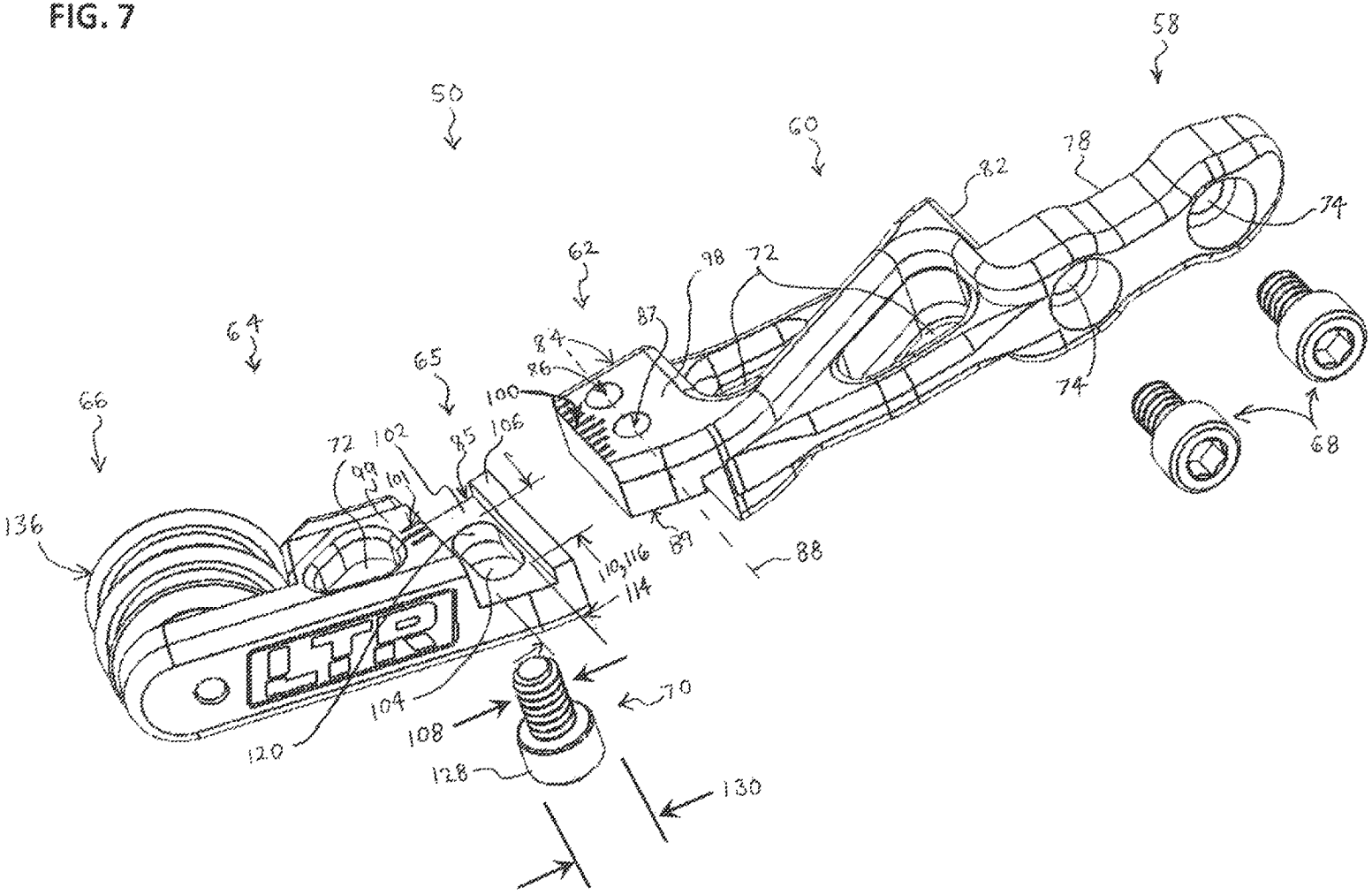
FIG. 7 is an exploded, top, isometric view of the archery cable director of FIG. 3.

In the embodiment shown in FIG. 7, the arm 60 and support 64 define a plurality of weight-reducing gaps 72. The weight reducing gaps 72 are configured to reduce the overall weight of the archery cable director 50 while maintaining a suitable structural strength of the archery cable director 50.

Figure 11:
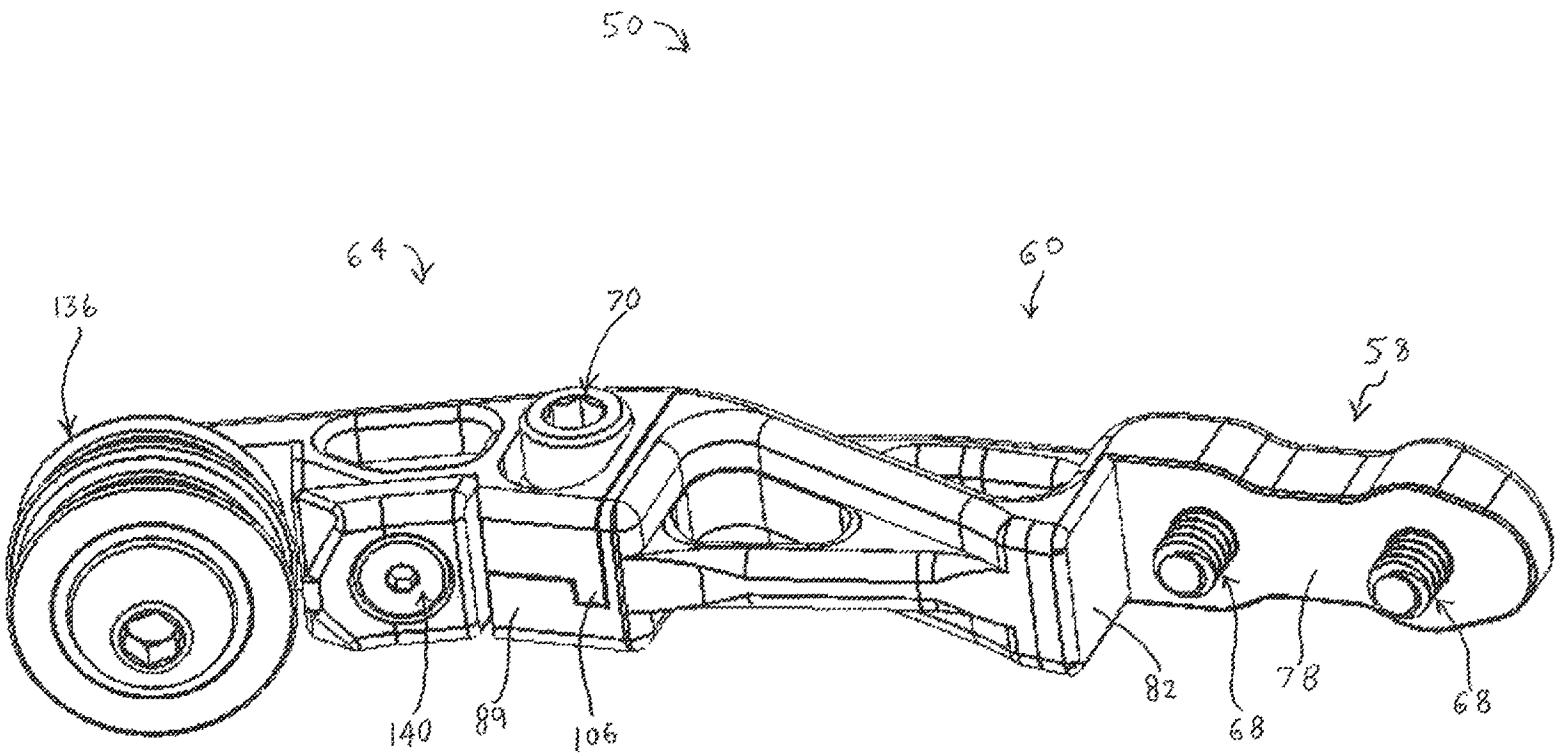
FIG. 11 is a bottom, isometric view of the archery cable director of FIG. 3.

In an embodiment, the proximal arm end 58 defines a plurality of fastener holes 74 (FIG. 7) configured to receive the mount fasteners 68. Also, as illustrated in FIG. 2, the floor 52 defines a plurality of threaded holes 76 that align with the fastener holes 74. In an embodiment, the user can insert the mount fasteners 68 through the fastener holes 74 and screw them into the threaded holes 76 to securely mount the arm 60 to the bow 10. When mounted, part or all of the proximal arm end 58 fits within the cavity 56 (FIG. 2). Also, as shown in FIGS. 7 and 11, the proximal arm end 58 has an L-shape, including: (a) a side mounting portion 78 configured to engage the floor 52 of a side 80 (FIG. 1) of bow 10; and (b) a back mounting portion 82 configured to engage the back 39 of the bow 10. The L-shaped proximal arm end 58 is configured to hug and surround multiple sides of the bow riser 12 to enhance the stability of the archery cable director 50 when mounted to the bow 10.

Figure 8:
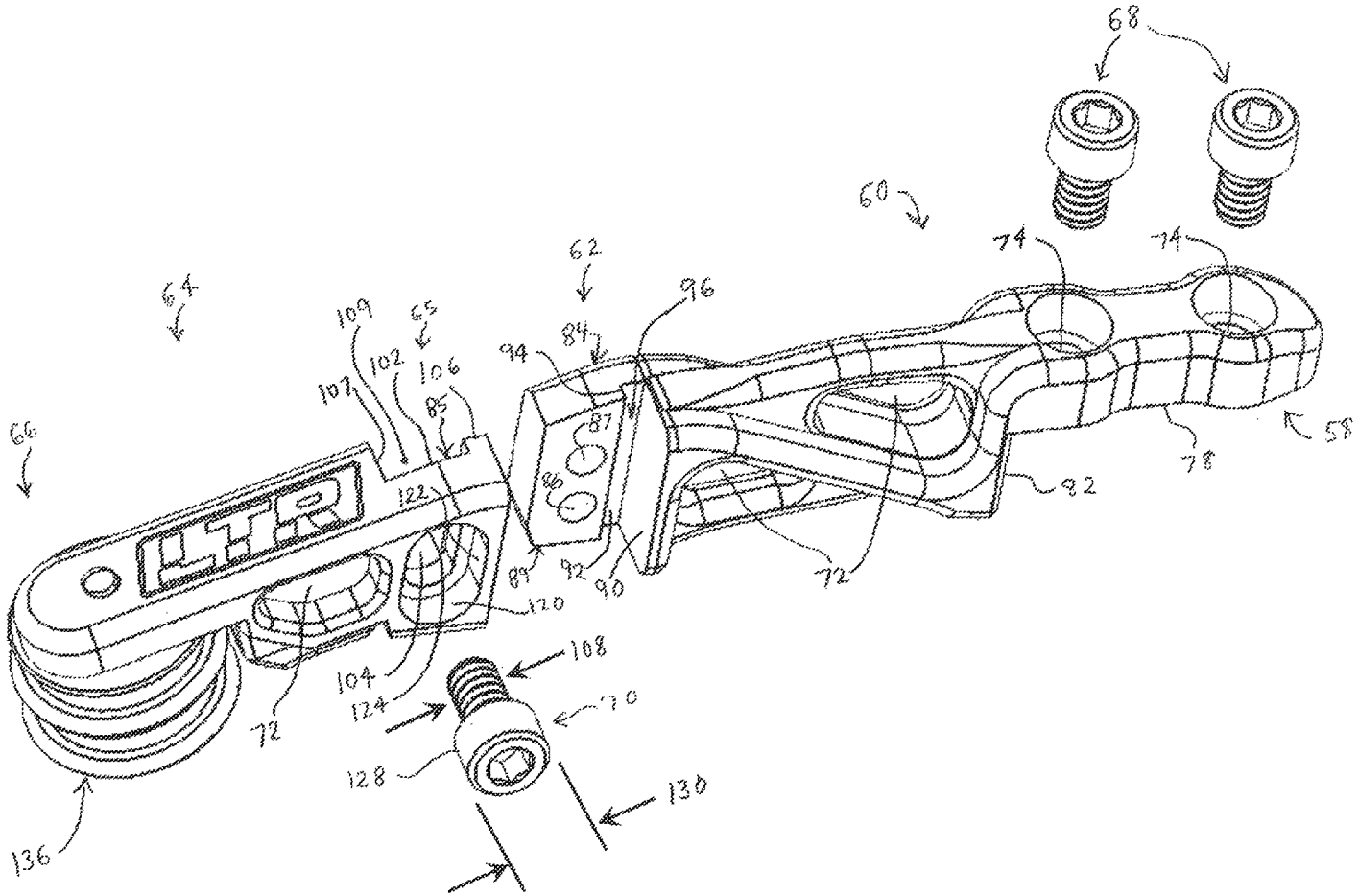
FIG. 8 is an exploded, bottom, isometric view of the archery cable director of FIG. 3.

As illustrated in FIGS. 7-8, the distal arm end 62 includes a coupling portion 84 configured to be slidably engaged with a coupling portion 85 of the proximal support end 64. In an embodiment, the coupling portion 84 defines an inward position-setting hole 86 and an outward position-setting hole 87, and these holes 86, 87 are spaced apart along lateral axis 88 (FIG. 7). The coupling portion 84 includes guide walls 90, 92, 94 which define a linear or straight slot 96 (e.g., a channel, groove, valley or crevice). In addition, the coupling portion 84 includes a notch or insert 89 through which the position-setting holes 86, 87 pass. As described below, the insert 89 is configured to fit and slide within the main slot 109 of the support 64.

Also, in the embodiment shown in FIG. 7, the coupling portion 84 has a top surface 98 including a positioning visual aid 100 (e.g., a plurality of equally-spaced apart markers). Likewise, the coupling portion 85 has a top surface 99 including a positioning visual aid 101 (e.g., a plurality of equally-spaced apart markers). Aligning the visual aids 100, 101 assists users with controlling and repeating the position setting of the support 64 relative to the arm 60.

As illustrated in FIGS. 7-8, in an embodiment the coupling portion 85 of proximal support end 65 includes: (a) a floor 102 defining an adjustment hole 104; (b) a lip 106 (e.g., a protrusion, upright wall, notch, peak, insert or follower) extending upward from the floor 102; and (c) a guide wall 107 (FIG. 8) extending upward from the floor 102 and spaced apart from the lip 106. Collectively, the floor 102, lip 106 and guide wall 107 define main slot 109 (e.g., a passage, channel, groove or cut-out space) configured to receive, and be slidably engage with, the insert 89 of the arm 60.

Figure 9:
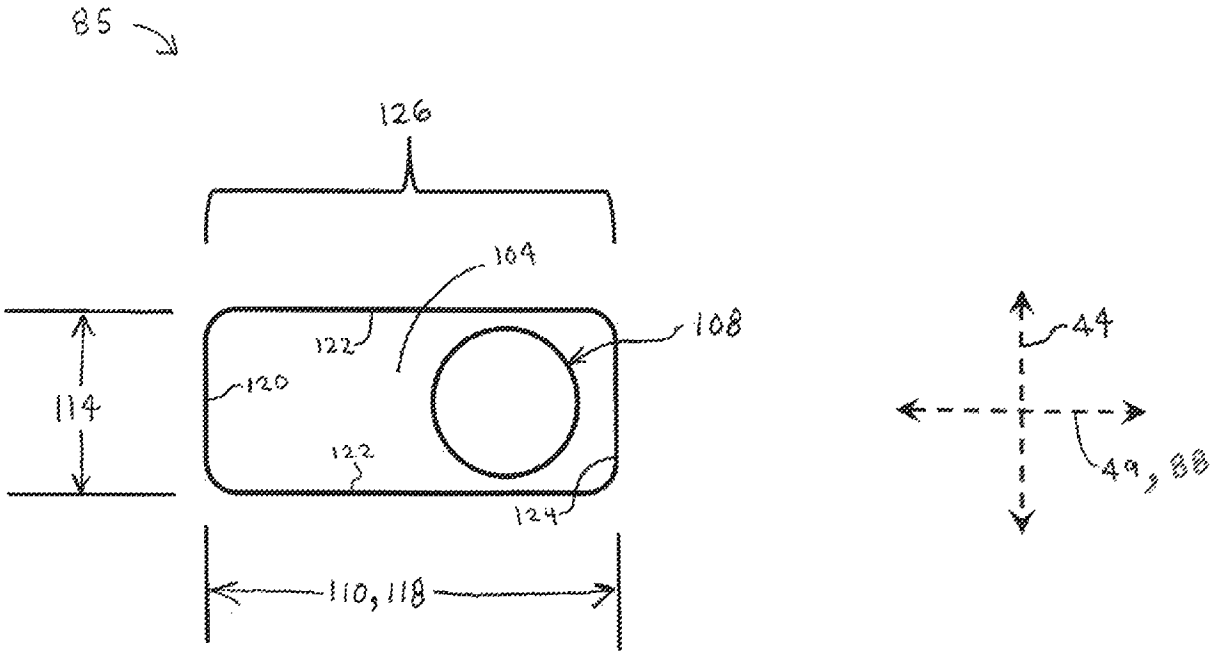
FIG. 9 is a schematic diagram illustrating an embodiment of a coupling portion of the support of an archery cable director.

Referring to FIG. 9, the adjustment hole 104 has at least one dimension (e.g., a length) that is substantially greater than the minor dimension 108 (e.g., minor diameter) of the adjustment fastener 70. For example, such dimension of adjustment hole 104 can be 10%, 50%, 100% or 200% greater than minor dimension 108. In the example shown in FIGS. 7-8, the adjustment hole 104 has an elliptical, rectangular or elongated shape including: (a) a major dimension 110 extending along or parallel to lateral axis 49, 88 (FIG. 7); and (b) a minor dimension 114 extending substantially along shooting axis 44 (FIG. 9). In the embodiment shown in FIGS. 7-8, the major dimension 116 is at least 1.5 times greater than the minor dimension 108 of the adjustment fastener 70. In the embodiment shown in FIG. 9, the major dimension 118 is more than double the minor dimension 108 of the adjustment fastener 70.

In an embodiment, the coupling portion 85 includes: (a) an inward adjustment stop 120 (e.g., an inwardly-located wall or surface); (b) a plurality of travel guide walls or guide surfaces 122; and (c) an outward adjustment stop 124 (e.g., an outwardly-located wall or surface). The inward and outward adjustment stops 120, 124 control, determine and define the adjustment zone 126 (FIG. 9) for the slide-based movement of the adjustment fastener 70 within the adjustment hole 104.

In an embodiment, the adjustment fastener 70 includes a head or retainer 128 (FIG. 7) having a major dimension 130, such as a major diameter. The major dimension 130 is greater than at least the minor dimension 114 of the adjustment hole 104. Consequently, when the adjustment fastener 70 is inserted through the adjustment hole 104 and screwed into the coupling portion 85, the retainer 128 loosely or securely holds the support 64. Whether the retainer 128 holds the support 64 loosely or securely, the continuous holding prevents the support 64 from becoming completely separated from the arm 60 during the position adjustment process. Accordingly, for adjustment purposes, the support 64 is configured to be slid relative to the arm 58 while the adjustment fastener 70 remains positioned through the adjustment hole 104 and into one of the position-setting holes 86, 87. That way, the support remains tethered or attached to the arm 58, avoiding risk of the support 64 becoming completely detached from arm 58.

Figure 10:
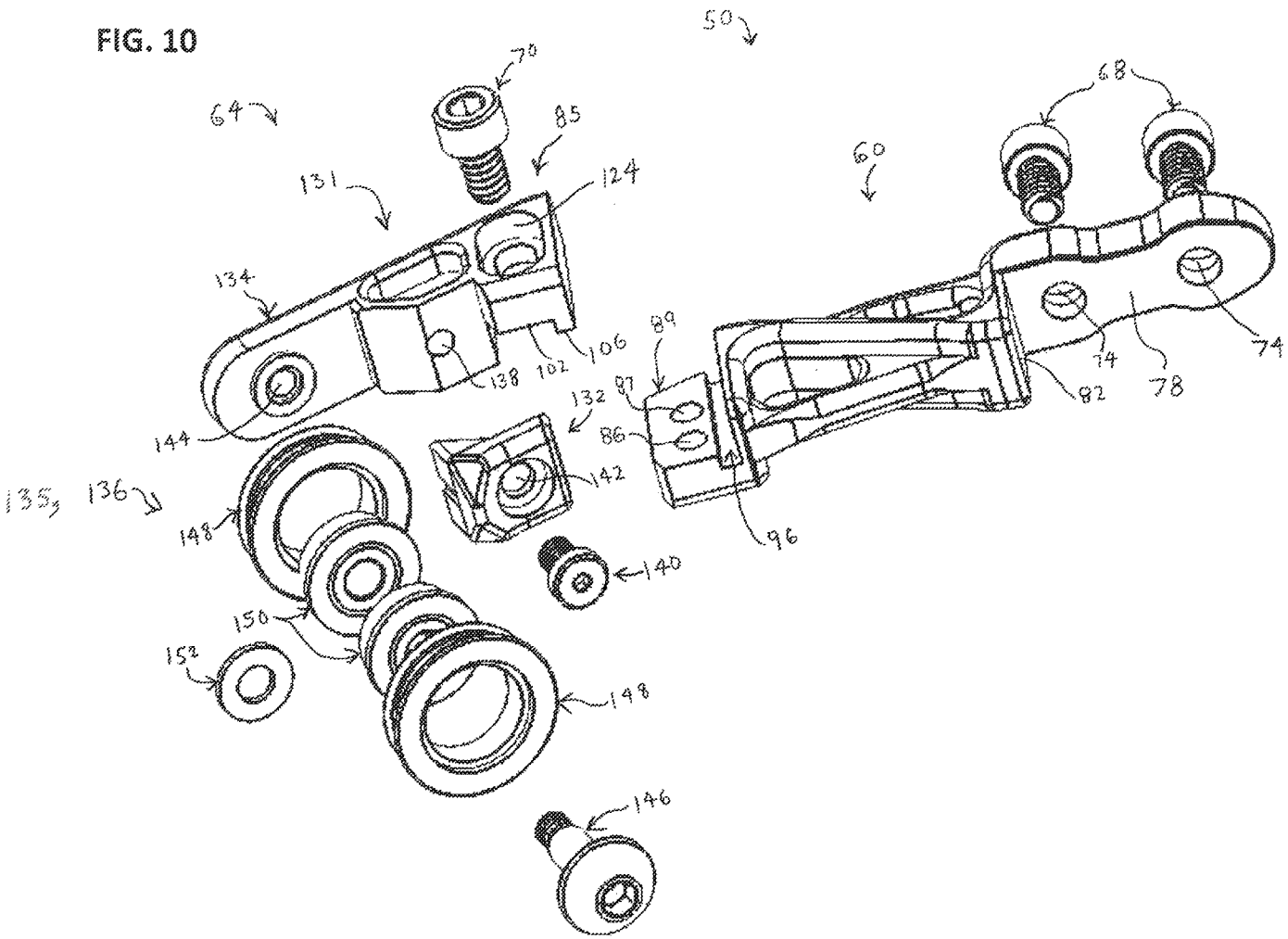
FIG. 10 is another exploded, top, isometric view of the archery cable director of FIG. 3, illustrating the removable cable retainer 132 and the internal components of the rotor assembly 136.

As illustrated in FIG. 10, the support 64, in an embodiment, includes: (a) an intermediate portion 131 extending from the coupling portion 85; (b) a cable bumper or cable retainer 132 removably connected to the intermediate portion 131; (c) a finger or extension 134 extending from the intermediate portion 131; and (d) a cable engager 135 coupled to the extension 134. In an embodiment, the cable engager 135 includes a rotor assembly 136 that is rotatably coupled to the extension 134.

The intermediate portion 131 defines a threaded fastener hole 138 configured to receive a threaded fastener 140. Also, the cable retainer 132 defines a pilot or pass-through hole 142. By inserting the fastener 140 through the hole 142 and screwing it into the fastener hole 138, the cable retainer 132 can be screwedly attached to the intermediate portion 131. By unscrewing fastener 140, the cable retainer 132 can be detached from the intermediate portion 131.

The extension 134 defines a shaft-receiving hole 144, and the rotor assembly 136 includes: (a) a shaft 146, such as an axle, screw, bolt, rod or tube, configured to be at least partially inserted into the shaft-receiving hole 144; (b) a plurality of rotational members or rotors 148 (e.g., wheels, disks or pulleys) that receive the shaft 146; (c) a plurality of bearings 150 that fit within the rotors 148 and also receive the shaft 146; and (d) one or more spacers or retainers, such as the illustrated washer 152, that also receives the shaft 146.

In an embodiment, the shaft-receiving hole 144 is threaded, and at least the end of the shaft 146 is threaded. To attach the rotor assembly 136 to the extension 134, the assembler inserts the shaft 146 through the rotors 148, bearings 150 and washer 152, and the assembler securely screws the shaft 146 into the threaded shaft-receiving hole 144.

Figure 12:
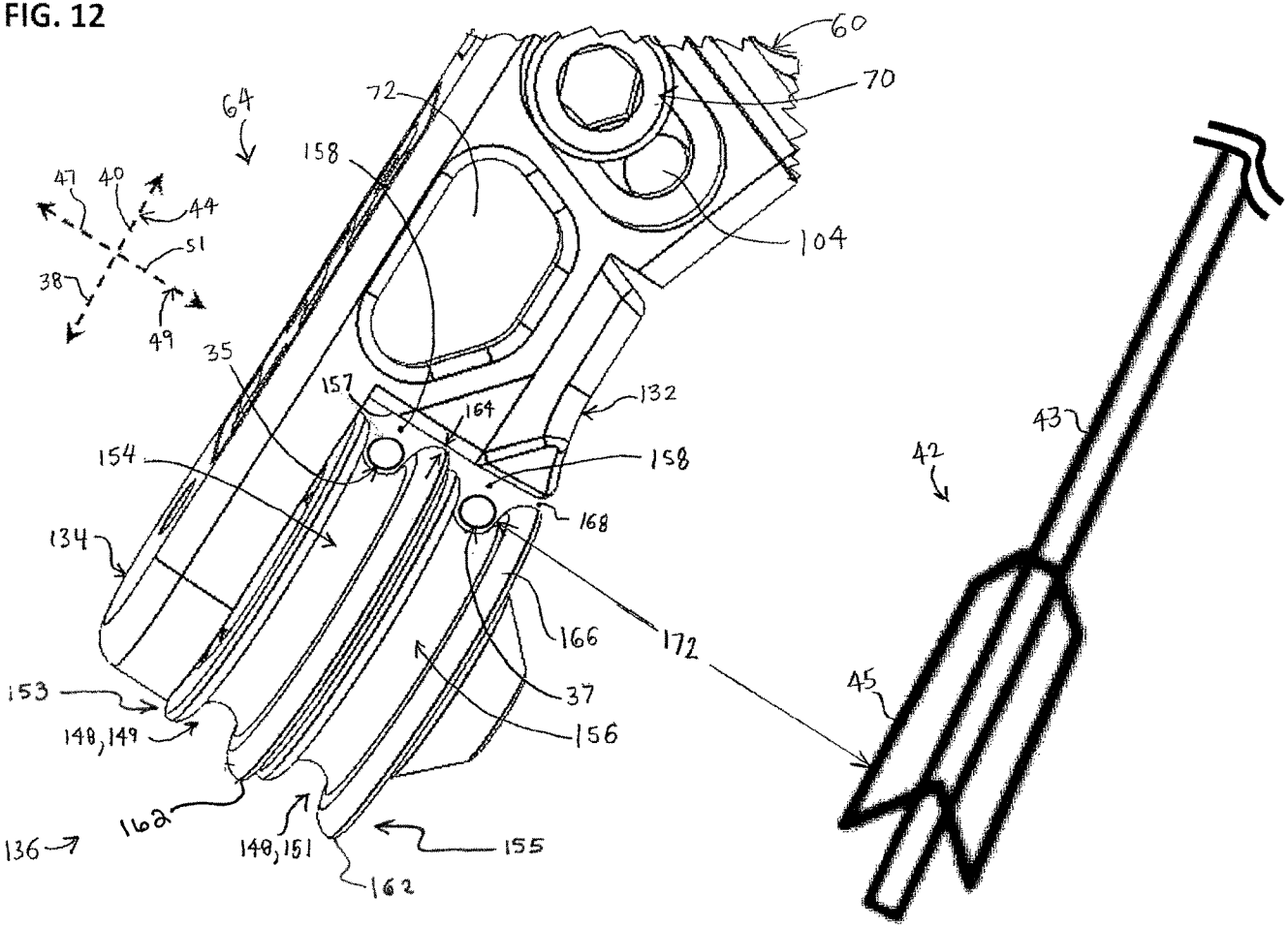
FIG. 12 is a fragmentary, enlarged, bottom, isometric view of the archery cable director of FIG. 3 with the cable retainer attached, illustrating distance between the archery cable director and the fletching of an arrow.

As illustrated in FIG. 12, it should be appreciated that, in the embodiment shown, that the extension 134 is positioned only at one side 153 of the rotor assembly 136. The extension 134 is not positioned at the other side 155 of the rotor assembly 136. This is accomplished, in part, because the extension 134 has a finger shape as opposed to a fork or yoke shape. The openly-accessible side 155 facilitates the installation and uninstallation of power cables 35, 36 with respect to the archery cable director 50.

Figure 13:
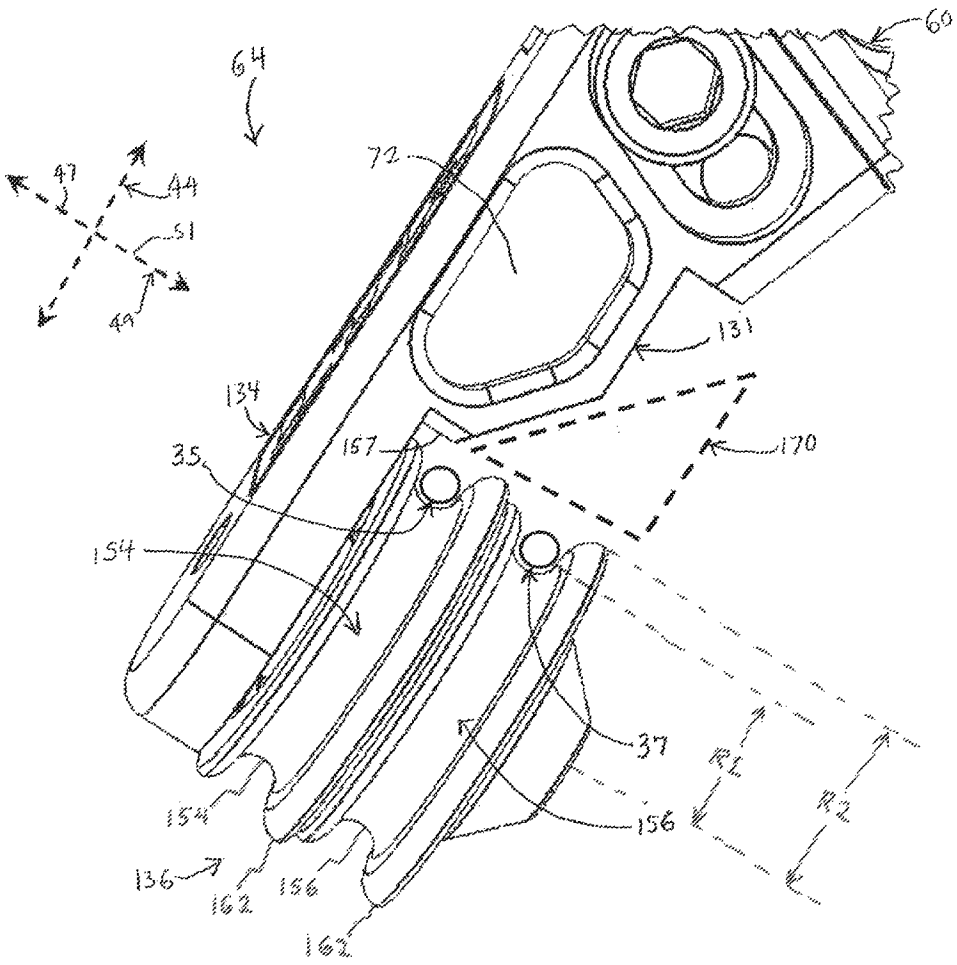
FIG. 13 is a fragmentary, enlarged, bottom, isometric view of the archery cable director of FIG. 3 without the cable retainer, illustrating an access space.

As illustrated in FIGS. 12-13, rotors 148 define valleys 154, 156. Each valley 154, 156 can be a groove, slot, channel or recess. After setup of the archery cable director 50, power cable 35 fits within valley 154, and power cable 37 fits within valley 156. When the cable retainer 132 is attached to the support 64, the cable retainer 132, intermediate surface 157 and extension 134 collectively define a dwell space 158 for receiving the cables 35, 37. The peak 162 of rotational member 149 is separated from the cable retainer 132 by a retaining space 164. Likewise, the peak 166 of rotational member 151 is separated from the cable retainer 132 by a retaining space 168. Retaining spaces 164, 168 are each smaller than the diameter of each of the cables 35, 37. Consequently, the cable retainer 132 blocks the cables 35, 37 from undesirably slipping laterally inward 51, along lateral axis 49. This impedes the cables 35, 37 from becoming fully disengaged from the rotor assembly 136 during operation of the bow 10.

As illustrated in FIG. 13, in an embodiment, each rotor 148 has: (a) a valley radius R1 between the center of the rotor 148 and the surface of the valley 154 or 156; and (b) a peak radius R2 between the center of the rotor 148 and the peak 162. Because of the peak radii R2, the retaining spaces 164, 168 are each smaller than the diameter of each of the cables 35, 37. Consequently, if cables 35, 37 were subject to an environmental, operational or unintentional human force urging the cables 35, 37 away from the rotors 148, the cable retainer 132 would block the cables 35, 37 from moving beyond the peak radii R2. This helps to prevent the cables 35, 37 from becoming fully disengaged from the rotor assembly 136 during operation of the bow 10.

In an embodiment, to install, adjust and use the archery cable director 50, the following steps are performed:

(a) attach support 64 to arm 60 using adjustment screw 70 as described above, wherein the adjustment fastener 70 can be partially or fully screwed into either one of the position-setting holes 86, 87 of the arm 60;

(b) at this stage, keep the cable retainer 132 detached from the support 64, resulting in access space 170 (FIG. 13);

(c) securely attach the arm 60 to the bow 10 using the mount fasteners 68;

(d) move the cables 35 and 37 laterally outward 47, inserting the cables 35 and 37 through the access space 170 (FIG. 13) into the valleys 154 and 156, respectively;

(e) using fastener 140 (FIG. 10), securely attach the cable retainer 132 to the support 64, eliminating or reducing the access space 170, resulting in dwell space 158 and retaining spaces 164, 168, as shown in FIG. 12;

(f) using the visual aids 100, 101, freely slide the support 64 relative to the arm 60 within the adjustment zone 126 (FIG. 9) so as to slide the support 64 from a first lateral position to a second lateral position causing the inward-most cable 37 to be a desired clearance distance 172 away from the fletching 45, as shown in FIG. 12;

(g) when reaching the second lateral position, tightly screw the adjustment fastener 70 into the arm 60 to secure, fix or lock the support 64 in the second lateral position for operation of the bow 10.

(h) when desiring to change or replace either cable 35 or 37, or when desiring to dismount the archery cable director 50 from the bow 10 (such as for transporting the bow 10), detach the cable retainer 132 from the support 64, resulting in the access space 170 (FIG. 13), and then slide cables 35, 37 laterally through access space 170 until the cables 35, 37 are fully disengaged from the archery cable director 50; and (i) when desiring to use a different arrow with a fletching larger or smaller than fletching 45 (FIG. 12), slightly or partially loosen the adjustment fastener 70, and then repeat the foregoing steps (f) and (g).

Referring to FIG. 12, during the lateral adjustment of the support 64 relative to the arm 60, the support 64 remains tethered to, hung from or otherwise coupled to the arm 60. This way, the user can incrementally slide the support 64 inward 51 or outward 47. During such sliding, as shown in FIG. 8: (a) the lip 106 is slidably engaged with the guide walls 90, 92, 94 of arm 60; and (b) the insert 89 is slidably engaged with the floor 102, guide wall 107 and lip 106 of support 64.

As described above, the user can use the inward position-setting hole 86 or the outward position-setting hole 87 for attaching the support 64 to the arm 60. For an arrow 42 with a relatively small fletching 45, the user can insert the adjustment fastener 70 into the inward position-setting hole 86; this results in a reduced amount of potentially harmful lateral force acting on the rotors 22, 24 of the bow 10. For an arrow 42 with a relatively large fletching 45, the user can insert the adjustment fastener 70 into the outward position-setting hole 87 to generate a suitable amount of distance 172 (FIG. 12) from the fletching 45.

Therefore, the archery cable director 50 has a plurality of adjustment modes. A first adjustment mode involves the adjustable selection of the inward position-setting hole 86 or the outward position-setting hole 87. A second adjustment mode involves the sliding movement of the support 64 relative to the arm 60 along the adjustment zone 126. These adjustment modes facilitate the setup, ease of use, adjustment and calibration of the archery cable director 50 for different types or sizes of arrows or for different user preferences.

It should be appreciated that in other embodiments not shown, the cable engager 135 includes a cable engagement surface (e.g., a hook or grasp) instead of rotor assembly 130. It should also be appreciated that, in an embodiment, the coupling portions 84 and 85 are interchangeable. For example, in embodiments not shown, the structure, elements and function of coupling portion 85 are incorporated into the distal arm end 62 of arm 60, and the structure, elements and function of coupling portion 84 are incorporated into the proximal support end 65 of support 64. Furthermore, the separate components of the archery cable director 50 can be connected or coupled together through the use of any suitable types of fasteners, including, but not limited to, fully-threaded, partially-threaded, or non-threaded bolts, screws, pins, clips, and wires. In addition, when a component's hole is threaded, as described above, to mate with a threaded fastener, it should be appreciated that, in other embodiments, such hole is not threaded. Rather, a primary fastener is inserted through the non-threaded hole, and a secondary fastener (e.g., a nut or clip) is attached to the end of the primary fastener.

Additional embodiments include any one of the embodiments described above and described in any and all exhibits and other materials submitted herewith, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The following is claimed:

1. An archery cable director comprising:
an arm comprising:
a first arm end configured to be coupled to an archery bow; and
a second arm end;
a support configured to be coupled to the arm, the support comprising:
a first support end configured to slideably mate with the second arm end; and
a second support end comprising an extension;
a rotor configured to engage a cable of an archery bow, wherein the rotor defines an opening, a valley, a peak distanced from the valley, and a radius extending from the opening to the peak; and
an axle that is at least partially inserted through the opening of the rotor, wherein the axle comprises:
a first axle end coupled to the extension; and
a second axle end,
a cable retainer; and
a fastener configured to couple the cable retainer to the support,
wherein, when the cable retainer is coupled to the support, the cable retainer is configured to interfere with a relocation of the cable to a position beyond the radius;
wherein, when the cable retainer is decoupled from the support, the support is configured to define an access space configured to enable the relocation of the cable to the position beyond the radius,
wherein the second arm end defines a first hole configured to receive an adjustment fastener,
wherein the first support end defines a second hole configured to receive the adjustment fastener, wherein the second hole is associated with an adjustment zone.

2. The archery cable director of claim 1, wherein the second hole comprises a minor dimension and a major dimension that is at least fifty percent greater than the minor dimension.

3. The archery cable director of claim 1, wherein, when the cable retainer is coupled to the support, a portion of the cable retainer is located opposite of the peak.

4. The archery cable director of claim 1, wherein the support is configured to be slid relative to the arm while the adjustment fastener is positioned through the first and second holes.

5. The archery cable director of claim 1, wherein:
the adjustment fastener comprises a head and a body extending from the head;
the body comprises a body diameter; and
the second hole is elongated and extends along an axis that, when the archery cable director is mounted to the archery bow, the axis intersects with a bowstring plane.

6. An archery cable director comprising:
an arm configured to be coupled to an archery bow;
a support coupled to the arm, wherein the support is configured to slideably mate with the arm to enable an adjustment of the support relative to the arm;
a cable engager coupled to the support, wherein:
the cable engager is configured to engage a cable of the archery bow, and
the support and the cable engager collectively define an access space that enable the cable to be moved into engagement with the cable engager; and
a cable retainer configured to be removably coupled to the support, wherein, when the cable retainer is coupled to the support, the cable retainer at least partially blocks the access space,
wherein the arm defines a first hole configured to receive an adjustment fastener; and wherein the support defines a second hole configured to receive the adjustment fastener, wherein the second hole is associated with an adjustment zone.

7. The archery cable director of claim 6, wherein the second hole comprises a minor dimension and a major dimension that is at least fifty percent greater than the minor dimension.

8. The archery cable director of claim 6, wherein the cable engager comprises a rotor.

9. The archery cable director of claim 6, wherein the cable engager comprises a valley and a peak.

10. The archery cable director of claim 9, wherein, when the cable retainer is coupled to the support, a portion of the cable retainer is located opposite of the peak.

11. The archery cable director of claim 6, wherein the support is configured to be slid relative to the arm while the adjustment fastener is positioned through the first and second holes.

12. The archery cable director of claim 6, wherein:

the adjustment fastener comprises a head and a body extending from the head;

the body comprises a body diameter; and the second hole is elongated and extends along an axis that, when the archery cable director is mounted to the archery bow, intersects with a bowstring plane.

13. The archery cable director of claim 6, wherein:

the arm comprises a first marker; and the support comprises a second marker, wherein an alignment of the first marker with the second marker indicates a position of the arm relative to the support.

14. A method comprising:

manufacturing an arm so that the arm is configured to be coupled to an archery bow; and manufacturing a support so that:

the support is configured to be coupled to the arm; and the support is configured to slideably mate with the arm to enable an adjustment of the support relative to the arm;

coupling a cable engager to the support so that the support and the cable engager collectively define an access space that enables a cable of the archery bow to be moved into engagement with the cable engager; and manufacturing a cable retainer so that:

the cable retainer is configured to be removably coupled to the support; and when the cable retainer is coupled to the support, the cable retainer at least partially blocks the access space, wherein manufacturing the arm comprises forming a first hole in the arm so that the first hole is configured to receive an adjustment fastener, wherein manufacturing the support comprises forming a second hold in the support so that the second hole is configured to receive the adjustment fastener, wherein the second hole is associated with an adjustment zone.

15. The method of claim 14, wherein the second hole comprises a minor dimension and a major dimension, wherein the major dimension is at least fifty percent greater than the minor dimension.

16. The method of claim 14, wherein providing the cable engager comprises providing a rotor.

17. The method of claim 16, wherein the rotor comprises a valley and a peak.

18. The method of claim 17, comprising manufacturing the cable retainer so that, when the cable retainer is coupled to the support, a portion of the cable retainer is located opposite of the peak.

19. The method of claim 14, wherein manufacturing the support comprises configuring the support to be slid relative to the arm while the adjustment fastener is positioned through the first and second holes.

20. The method of claim 19, wherein:

the adjustment fastener comprises a head and a body extending from the head;

the body comprises a body diameter; and the second hole is elongated and extends along an axis that, when the arm is mounted to the archery bow, the axis intersects with a bowstring plane.

* * * * *